United States Patent [19]

Bezborodko

[11] 4,452,022

[45] Jun. 5, 1984

[54] MIRRORED WALL SYSTEM

[76] Inventor: Joseph Bezborodko, 5235 Fieldston Rd., Bronx, N.Y. 10471

[21] Appl. No.: 403,549

[22] Filed: Jul. 30, 1982

[51] Int. Cl.[3] ..... B44F 7/00

[52] U.S. Cl. ..... 52/311; 52/509; 52/511; 52/420; 52/416

[58] Field of Search ..... 52/417, 420, 506, 509, 52/311, 469, 459, 511; 428/912.2, 210

[56] References Cited

U.S. PATENT DOCUMENTS

| | | | |
|---|---|---|---|
| 1,651,332 | 11/1927 | Langer | 52/469 |
| 3,364,639 | 1/1968 | Davenport | 52/511 |
| 4,143,496 | 3/1979 | Destito | 52/173 R |
| 4,158,274 | 6/1979 | Saenz | 52/311 |

*Primary Examiner*—John E. Murtagh

*Assistant Examiner*—Kathryn L. Ford

*Attorney, Agent, or Firm*—Gottlieb, Rackman & Reisman

[57] ABSTRACT

A modular mirrored wall system, particularly applicable for do-it-yourself installation, includes a plurality of mirrored panels of predetermined width and height. Each mirrored panel having framed edges and a bonded cardboard, fiberboard or other back to provide rigidity in the panels and ease in handling. Metal straps, secured to the panel frame, facilitate fastening of the mirrored panels to a wall. The system also includes at least one mirrored strip, having the same height as the mirrored panel but of smaller width. The mirrored strip is fixedly secured to the mirrored panels in order that the mirrored wall system may be adjusted to accommodate different size walls, the mirrored strip concealing from view the space between adjacent mirrored panels.

5 Claims, 4 Drawing Figures

FIG. 3
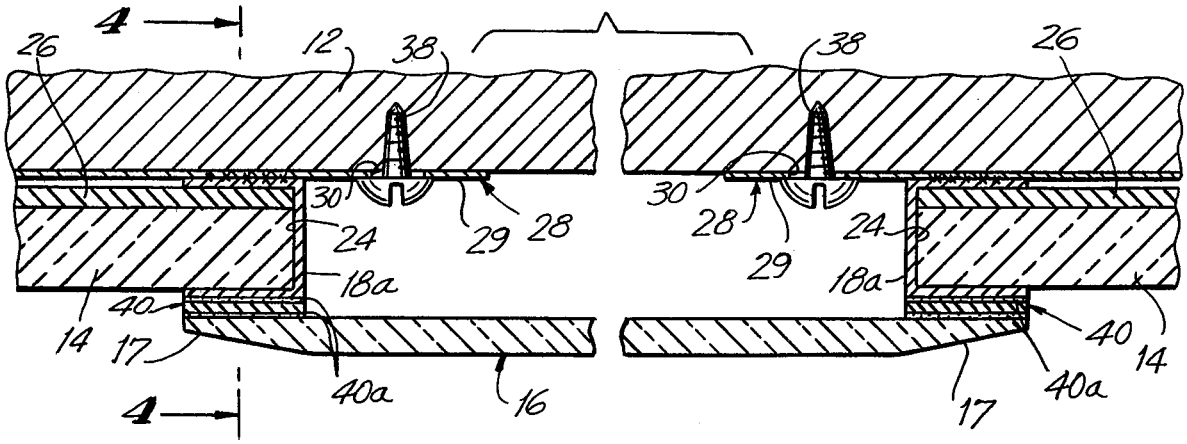
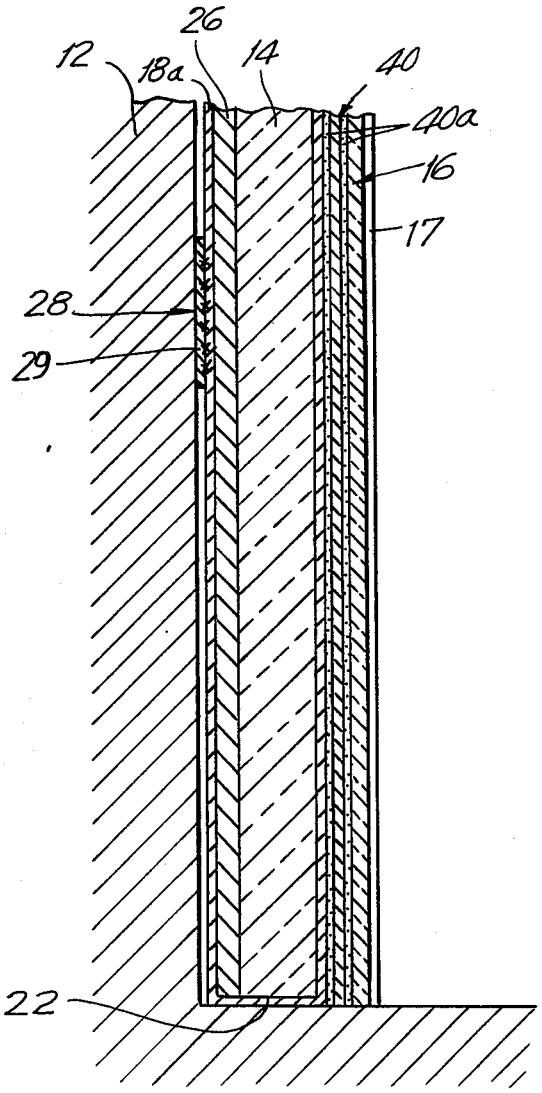
FIG. 4

MIRRORED WALL SYSTEM

This invention relates generally to decorative panels and, more particularly, to a mirrored wall system for decorative use.

In contemporary interior design, it is quite fashionable to use mirrors as a decorative technique. Mirrored walls provide an air of spaciousness and luxury while also maximizing the utilization of natural window and fixture lighting. For these and other reasons, mirrors are commonly used to cover one or more walls of a room for decorative effect.

In order to provide the luxury of wall-to-wall mirrored walls, however, it has heretofore been necessary to employ the skills of craftsmen to custom design and install mirrored wall systems. In the design of mirrored systems known to the art, mirrored panels are custom cut to accommodate wall spaces which are to be mirrored. These panels which are usually fabricated of a thick gauge glass to provide rigidity, are commonly glued to wall surfaces with the side edges of adjacent panels being flush with each other.

Such mirrored wall systems are particularly expensive to fabricate and install, since the mirrored system must be custom designed and cut to the dimensional specifications of the wall which is to be mirrored and custom installed by craftsmen. It will also be appreciated that the thick gauge glass required in order to provide necessary rigidity in the mirrored panels is expensive to fabricate and heavy to handle. For these reasons, although use of mirrors on walls can provide a desirable decorative effect, such use has been limited by the expenses involved.

Heretofore, the only alternative to costly custom installation has been the use of standardized mirrored squares, adapted for adhesive fastening to wall surfaces. Although these mirrored squares can be installed much less expensively than custom installations using mirrored panels, difficulties have been encountered which have made the use of such small mirrored squares less than a satisfactory alternative. For example, in the installation of mirrored squares, it is often found that the squares do not fit properly and the mirrored surface provided is for this reason broken up by a confusing clutter of reflections. As a further disadvantage, the mirrored edges of the squares often chip or crack during installation due to the difficulty in properly aligning and placing adjacent squares, detracting from the aesthetic effect of such systems.

Accordingly, it is a broad object of the present invention to provide a new and improved mirrored wall system.

A more specific object of the present invention is to provide a mirrored wall system which can provide a decorative mirrored wall having the "look" of more expensive custom installations, at a significantly decreased cost.

Another object of the present invention is to provide a mirrored wall system fabricated of panels of a lesser gauge thickness than according to prior art systems in order to effect economies in design and fabrication of a wall-to-wall mirrored system.

Yet another object of the present invention is to provide a mirrored wall system of pre-cut mirrored panels and mirrored strips which can be handled easily and installed relatively quickly by unskilled persons.

These and other objects of the present invention are attained by providing a mirrored wall system formed by a plurality of pre-cut mirrored panels of predetermined height and width. The mirrored panels are fabricated of glass of a thin gauge thickness and provided with bonded fiberboard, cardboard or other backing members for rigidity. Each mirrored panel is encased along its edges with a protective frame which receives the mirrored panel and backing member, thereby shielding the raw mirror edges and permitting the mirrored panels to be handled relatively safely and easily by the do-it-yourself installer. The frame includes fastening members which extend outwardly past the side edges of the frame in the plane of the mirrored panel. This facilitates placement and installation of the mirrored panels in aligned relation. The system also includes at least one mirrored strip, preferably having beveled side edges, which is fixedly secured to the mirrored panels in overlying relation with respect to the side edges of the framed mirrored panels. The mirrored panels may advantageously be positioned in spaced relation to one another in order to accommodate walls of different dimensions; the mirrored strips providing an adjustability feature in the mirrored wall system by overlying the space between adjacent mirrored panels.

The above brief description of the present invention will be more readily apparent by reference to the following detailed description of a preferred, but nonetheless illustrative, embodiment of the invention when taken in conjunction with the following drawings, wherein:

FIG. 3 is a sectional view, enlarged in scale, taken along the line 3—3 of FIG. 1; and FIG. 4 is a partial sectional view along the line 4—4 of FIG. 3.

Figure 1:
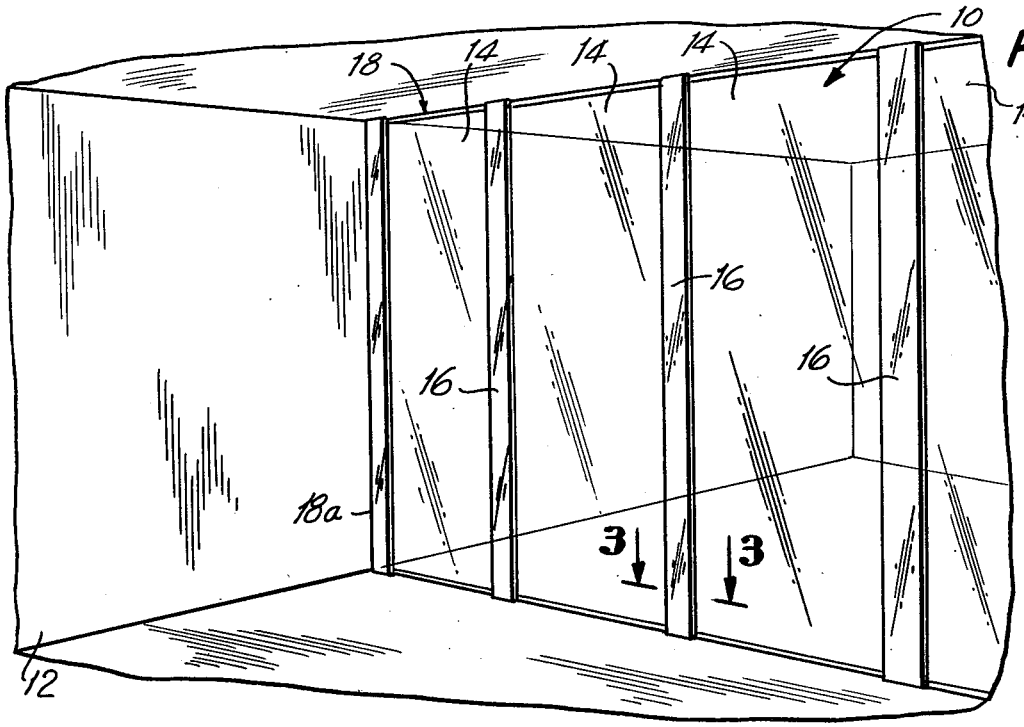
FIG. 1 is a perspective view of a mirrored wall system according to the present invention attached to one wall of a room.

Referring now to the drawings and, more particularly, to FIG. 1 thereof, a mirrored wall system according to the present invention is generally designated 10. The mirrored wall system 10 is adapted to be secured to one or more walls 12 of a room. As shown in FIG. 1, the mirrored wall system 10 is secured to the right-hand wall 12 of a room, while the left-hand wall 12 is left bare. However, the mirrored wall system may be secured to more than one wall, if so desired.

The mirrored wall system 10 is a pre-cut modular system, which includes a plurality of mirrored panels 14 and one or more mirrored strips 16 which, as explained hereinafter, overlie the space between adjacent mirrored panels to provide a modular adjustability feature of the invention.

The mirrored panels 14 are advantageously formed of the same height, for example, 84 inches, and are available in predetermined but different widths, for example, 24 inches, 30 inches and 36 inches. The mirrored strips 16 are the same height as the mirrored panels, namely, 84 inches, but are substantially narrower than the panels. Mirrored strips 16 may, for example, be approximately 6 inches in width. In order to provide a uniform mirrored facade, the mirrored strip 16 has inwardly bevelled edges 17 oriented towards mirrored panels 14 (see FIG. 3).

Figure 2:
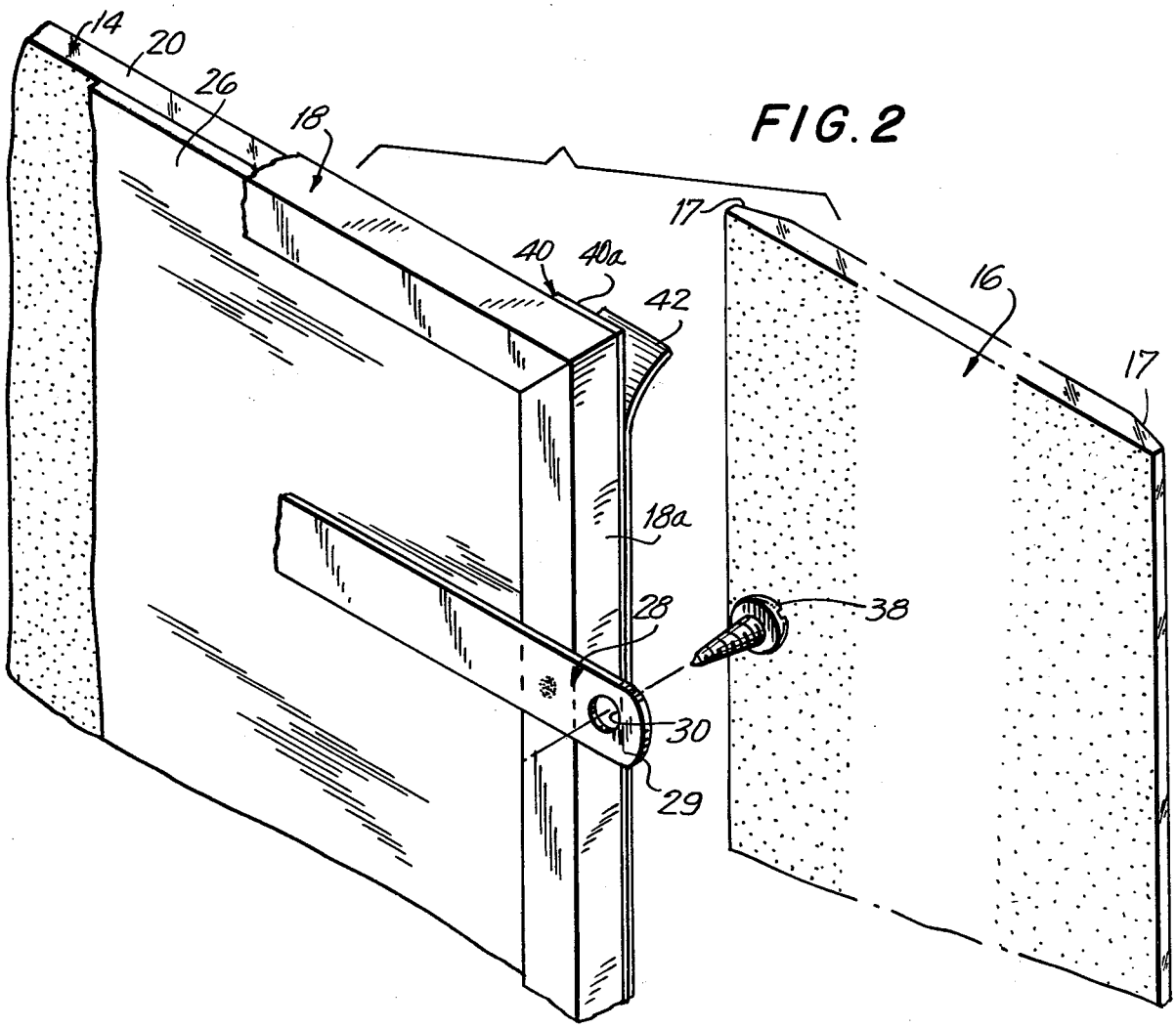
FIG. 2 is an exploded rear perspective view, showing one mirrored panel and a mirrored strip of the mirrored wall system of the invention.

Each mirrored panel 14 is provided with a frame 18, which surrounds the top edge 20, bottom edge 22 and side edges 24 of the panel. The frame 18 is of a conventional design and may be formed of metal, plastic, wood or other material. Frame 18 also receives a cardboard or fiberboard backing member 26 which may be bonded to the mirrored panel 14, thereby making the mirrored panel "shatter-resistant" (see FIG. 2).

Frame 18 provides several advantages. First, it facilitates handling of mirrored panel 14 by protecting the user from injury on the "raw" glass edges 20–24. The frame 18, in combination with the cardboard or fiberboard backing 26, also imparts rigidity to the mirrored panels 14 permitting use of thinner gauge glass for the mirrored panels 14. In the preferred embodiment of the invention, for example, the mirrored panels 14 have a thickness in the range of $\frac{1}{8}$ of an inch. This provides for manufacturing economies not obtained in prior art custom designed systems wherein the mirrored panels are commonly fabricated of glass having a thickness in the range of $\frac{1}{4}$ of an inch. The framed mirrored panels 14 with backing numbers 26 are also of a lightweight construction, facilitating their handling and installation. Mirrored strip 16 which is of a narrower width does not require a backing member 16 for rigidity and may, for example, be provided with a thickness in the range of 3/16 of an inch.

As a further advantage, the frame 18 by encasing mirrored panel edges 20–24 conceals defects and discoloration in the mirror which frequently occur at the mirror edges. Finally, in the installation of the mirrored wall system 10, the frame 18 allows the mirrored panel 14 to be aligned and secured to wall 12 by a fastening arrangement of uncomplicated design, without the need for gluing the panels to the wall.

To this end, frame 18 is provided with fastening member 28, which is secured to the frame 18 by welding or the like, having end sections 29 which extend outwardly past side edges **18*a* of the frame, in the plane of the mirrored panel 14. To add further rigidity to the mirrored panel 14, fastening members 28 preferably comprise spaced metal "straps" extending between the side edges 18*a* of the frame 18 (see FIGS. 2 and 3). The end sections 29 of the straps 28 are provided with apertures 30 which receive transversely extending wall fastening screws 38**.

In the installation of the mirrored wall system 10, the mirrored panels 14 are positioned in aligned relation and secured to wall 12 by fastening screws 38 which extend transversely through apertures 30 into wall 12 (see FIG. 3). Mirrored strip 16 is positioned in overlying relation with respect to the frame side edges **18*a* and secured in fixed relation with the adjacent mirrored panels 14 by conventional fastening techniques known in the art. In order to assure a secure arrangement of the mirrored panels 14 and strip 16, it is preferable to position mirrored panels 14 such that mirrored strip 16 overlies frame side edge sections 18*a*, it being understood that the mirrored strips may overlie the surface of mirrored panels 16 to effect required width adjustments in the mirrored wall system 10 (see FIG. 3**).

An adhesive tape 40 having adhering surfaces **40*a* and peel-off non-adhesive protective coatings 42 may advantageously be employed for purposes of securing mirrored strips 16 to mirror panels 14. Adhesive tape 40 provides advantages over conventional fastening arrangements wherein glues or hardware are commonly employed, by facilitating arrangement of mirrored strips 16 in proper orientation relative to mirrored panels 14. Difficulties are presented in methods employing glues where care must be taken to apply proper coatings of the glue in order to effectively secure and bond the mirrored strip 16 to the underlying mirrored panels 14. Similarly, in methods employing hardware, fastening openings must be precisely positioned in the mirrored strip 16 requiring the skills of craftsmen. Adhesive tape 40 provides a modern aesthetically pleasing arrangement of mirrors without requirement of positioning ornamental hardware on the surface of the mirrored panels 14 and strips 16 or employment of gluing procedures (see FIG. 1**).

It will be appreciated, with particular reference to FIG. 3, that mirrored strip 16 provides an adjustability feature in the mirrored wall system 10 by permitting spaced positioning of mirrored panels 14, while overlying the space defined by such panels, so that the mirrored wall system 10 can accommodate walls having a range of lengthwise dimensions. For walls of large expanse, the mirrored system may advantageously employ a number of mirrored strips 16, the lengthwise adjustability of the wall system 10 being defined in such cases by the width and number of mirrored strips 16 employed in the mirrored system 10, as well as by the width and number of panels 14.

From the foregoing, it will be appreciated that the present invention provides a modular mirrored wall system 10 which obtains a decorative wall-to-wall mirrored look and which achieves the objectives heretofore stated.

In particular, the present invention provides a mirrored wall system 10 of standardized design which includes pre-cut mirrored panels 14 and a mirrored strip 16 which can be readily positioned and secured to a wall 12 to provide a wall-to-wall mirrored facade. The mirrored panels 14 are provided with bonded fiberboard backing members 26 and a frame 18 in a secure and rigid arrangement. The framed mirrored panels 14 are positioned and secured in aligned relation to wall 12 by a fastening means including strap bands 28 which extend lengthwise between side edges **18*a* of frame 18. Strap bands 28 terminate in end sections 29 having apertures 30 which receive wall fastening screws 38. An adjustability feature in the mirrored wall system 10 is provided by mirrored strips 16 which overlie frame edges 18*a* of aligned and spaced mirror panels 14. Adhesive tape 40 is employed to secure mirrored strip 16 to mirrored panels 14** to provide a mirrored wall having an aesthetically uniform mirrored look.

Advantageously, the mirrored wall system 10 is of an uncomplicated construction and suitable for ready installation by unskilled persons. A novel mirrored panel construction including the backing member 26 and frame 18 with welded straps 28 provides rigidity to mirrored panels 14 permitting economical fabrication of such panels out of thin gauge glass. In accordance with the invention, the mirrored panels 14 may be fabricated of glass having a thickness in the range of $\frac{1}{8}$ of an inch.

Numerous modifications are possible in light of the above disclosure. By way of example, although an adhesive tape 40 has been disclosed for securing mirror strips 16 to mirror panels 14, other securing means may be devised. Similarly, fastening means other than straps 28 may be employed to secure mirrored panels 14 to wall 12. It is to be understood, therefore, that the above described embodiments are merely illustrative and other embodiments may be devised by those skilled in the art, without departing from the spirit or scope of the present invention, as set forth in the appended claims.

There is claimed:

1. A modular mirrored wall system comprising:

a plurality of mirrored panels of predetermined width and height, each of said panels having top, bottom and side edges, said mirrored panels further including backing panels, said backing panels providing rigidity to said mirrored panels;

a framing means for each of said mirrored panels, said framing means including a framing member having top, bottom, and side edges which respectively encase the top, bottom and side edges of each of said mirrored panels;

at least one securing strap for securing each of said mirrored panels to the wall, said securing strap extending between the side edges of said framing member and terminating in end sections disposed outwardly of the side edges of said framing member, each of said end sections including an aperture adapted for securing said framing member to the wall;

at least one mirrored strip, said strip being of the same height as the mirrored panels but of smaller width; and means for fixedly securing said mirrored strip in overlying relation with respect to the side edges of adjacent mirrored panels so that when the adjacent mirrored panels are positioned in spaced relation, the mirrored strip overlies the space defined by the edges of said mirrored panels to provide an adjustability feature in the mirrored wall system.

2. A mirrored wall system according to claim 1 wherein said means for securing the mirrored strip comprises an adhesive tape.

3. A mirrored wall system according to claim 1 wherein said mirrored panels have a thickness in the range of $\frac{1}{8}$ of an inch.

4. A mirrored wall system according to claim 1 wherein said mirrored strip has a thickness in the range of 3/16 of an inch.

5. A mirrored wall system according to claim 1 wherein said mirrored strip has a width in the range of 6 inches.

* * * * *